United States Patent [19]

Keller et al.

[11] Patent Number: 4,476,611

[45] Date of Patent: Oct. 16, 1984

[54] FIBER FEEDING APPARATUS WITH FIBER LEVELING MEANS

[75] Inventors: Alex J. Keller, Clover, S.C.; Akiva Pinto, Gastonia, N.C.

[73] Assignee: Automatic Material Handling, Inc., Bessemer City, N.C.

[21] Appl. No.: 340,635

[22] Filed: Jan. 19, 1982

Related U.S. Application Data

[63] Continuation-in-part of Ser. No. 207,394, Nov. 17, 1980, abandoned, which is a continuation-in-part of Ser. No. 190,818, Sep. 25, 1980, abandoned.

[51] Int. Cl.[3] ..... D01G 15/40

[52] U.S. Cl. ..... 19/105; 222/57; 406/70; 406/171

[58] Field of Search ..... 19/105; 222/52; 406/70, 406/171

[56] References Cited

U.S. PATENT DOCUMENTS

| | | | |
|---|---|---|---|
| 3,482,883 | 12/1969 | Hecker | 406/175 |
| 3,728,759 | 4/1973 | Hergeth | 19/105 |
| 3,896,523 | 7/1975 | Beukert | 19/105 |
| 4,009,803 | 3/1977 | Lytton et al. | 19/105 X |
| 4,136,911 | 1/1979 | Husges et al. | 19/105 X |
| 4,161,052 | 7/1979 | Erben | 19/240 |
| 4,176,988 | 12/1979 | Lattmann | 19/105 X |
| 4,219,289 | 8/1980 | Trützschler | 19/105 X |
| 4,240,180 | 12/1980 | Wood | 19/105 |
| 4,280,251 | 7/1981 | Ludwig | 19/105 |

FOREIGN PATENT DOCUMENTS

| | | | |
|---|---|---|---|
| 2835114 | 3/1979 | Fed. Rep. of Germany | 19/105 |
| 1184747 | 3/1970 | United Kingdom . | |

*Primary Examiner*—Louis Rimrodt

*Attorney, Agent, or Firm*—Richards, Shefte & Pinckney

[57] ABSTRACT

A chute feed having an opening roller and a vertical chute therebeneath for receiving and collecting fibers, the chute having one generally vertical side wall formed with an area of perforations extending above and below the normal level of fibers collected in the chute, and a blower for generating an air current around the upper portion of the opening roller and toward the perforations to entrain fibers leaving the roller and to assist in equalizing the level of fibers collected in the chute. A fiber level sensing device is provided adjacent the area of wall perforations to control the flow of fibers from the opening roller to the chute.

13 Claims, 3 Drawing Figures

FIBER FEEDING APPARATUS WITH FIBER LEVELING MEANS

CROSS-REFERENCE TO RELATED APPLICATIONS

This application is a continuation-in-part application of U.S. patent application Ser. No. 207,394, filed Nov. 17, 1980, now abandoned, which is, in turn, a continuation-in-part of U.S. patent application Ser. No. 190,818, filed Sept. 25, 1980 and now abandoned.

BACKGROUND OF THE INVENTION

In chute feeds and similar devices for collecting and densifying fibers to be fed as a batt to carding machines and the like, it is important that the batt have a uniform density to prevent defects being formed in the yarn that is ultimately produced from the batt.

Since the fiber normally flows to the chute in relatively loose tufts, it is common practice to provide some arrangement for compressing or densifying the fiber in the chute so that the fiber emerges as a batt. For example, Beukert U.S. Pat. No. 3,896,523, issued July 29, 1975, discloses a feeding device having an oscillating shaker plate or spanker plate that moves toward and away from an opposite fixed wall to densify the fibers in a generally uniform manner, the speed of oscillation of the plate being controlled by the rotational speed of the feed rollers which supply fiber thereto.

Compression of the fibers in a chute may also be obtained using a flow of pressurized air that acts to compress the fibers collected in the chute, and this pressurized air may be obtained from a bellow or a more complex air flow arrangement of the type disclosed, for example, in Husges U.S. Pat. No. 4,136,911.

Finally, it is also known that the flow of air used to carry fiber to a chute may be controlled by providing slots in the wall of the chute and using adjustable needles to vary the open portion of such slots as disclosed in Hecker U.S. Pat. No. 3,482,883.

When pressurized air flows into, through, and beyond the chute to compress the fibers it will pick up lint which must be separated from the air after it leaves the chute, thereby requiring additional filtering equipment or burdening the existing filtering equipment. Additionally, the forces imposed on the fiber by the air is generally uniform across the surface of the collected fiber, and if the level of fiber is uneven, the generally equal compression provided by the air may result in the collected fiber having an uneven density across its width. On the other hand, oscillating spanker plates avoid the problem of requiring additional air filtration, but the indiscriminate feeding of fiber tufts to the spanker plate may result in uneven fiber levels that will be compressed to different densities across the width of the spanker plate.

By contrast, the present invention provides a chute which does not require any additional air filtration while also improving significantly the uniformity of the fiber density as it leaves the chute in batt forms.

SUMMARY OF THE INVENTION

In accordance with the present invention, a fiber feeding apparatus is provided with an opening roller disposed above a substantially enclosed fiber collecting chute which receives fiber from the opening roller along the axial length thereof, and one downwardly extending wall of the chute includes a plurality of perforations formed therein in an area extending above and below the normal level of fiber collected in the chute. Means are provided for generating a flow of air around the upper portion of the opening roller and generally tangentially toward the perforations in the chute wall. Since the normal level of collected fiber is within the area of perforations, any variations in the level of the fiber will result in the perforations being covered to a greater extent at the area where the fiber level is highest and to a lesser extent at areas where the fiber level is low. As a result, more air will flow to the area where the fiber level is low and vice versa, and since the tufts of fiber leaving the opening roller will be entrained in the air flow, more of such tufts will be carried to the areas where the level of fiber is low, thereby generally equilizing the level of the fiber in the chute.

Additionally, in a second embodiment of the present invention, the aforesaid perforations may be formed in the chute wall in an area that is adjacent to (e.g. just below) the normal level of fibers collected in the chute. In this embodiment, the perforations are generally covered by the fiber collected in the chute, but because the perforations are located quite near the fiber level, any variations in the fiber level across the width of the chute will still result in the air flowing to the area where the fiber level is low, and vice versa, in the same manner as that described above, thereby tending to equalize the level of fibers collected in the chute across the width thereof.

Preferably, the chute is provided with a spanker plate to compress the fibers therein beneath the perforated wall portion, and, as a result, high pressure air is not required to compress the fibers and a relatively gentle flow of air can be used. Because only a relatively gentle flow of air is required, such air flow can be obtained using a relatively small blower to establish a closed air circuit contained within the chute whereby filtering of the air is not required, and the air flow can also be effectively utilized to assist in separating the fiber tufts from the opening roller.

A fiber level sensing device, such as an electric eye, may be disposed in the chute at the aforesaid normal level of the fiber, and this sensing device is used to control the flow of fiber from the opening roller to the chute.

DESCRIPTION OF THE PREFERRED EMBODIMENTS

Figure 1:
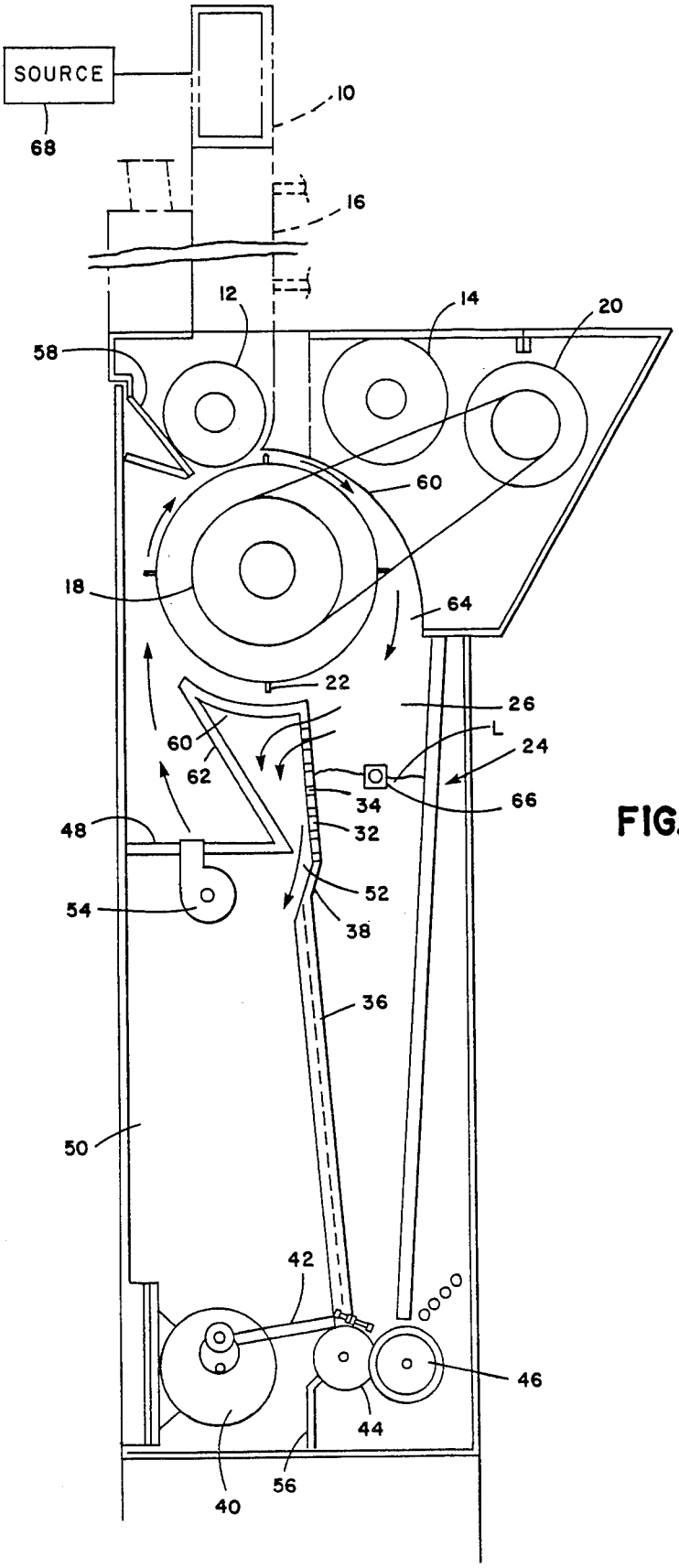
FIG. 1 is a diagrammatic side elevational view of the fiber feeding apparatus of the present invention.

Looking now in greater detail at the accompanying drawings, FIG. 1 illustrates a fiber collecting and feeding device having an inlet duct 10 through which fiber from a source 68 is delivered in an air stream to a feed roller 12 that is rotated by a motor 14, the inlet duct 10 having an outlet 16 through which the carrying air is exhausted for filtering and subsequent use in a conventional manner. The feed roller 12 delivers the fiber to a conventional opening roller 18 that extends axially along substantially the entire width of the apparatus and that is driven by a motor 20, the opening roller 18 having a plurality of projections 22 extending from the circumferential surface to open the fiber tufts fed to the opening roller 18.

A substantially enclosed chute 24 extends generally downwardly beneath the opening roller 18 and has an open end 26 extending along and parallel to the axis of the opening roller 18 to receive fiber as they leave the surface thereof. The chute 26 includes a stationary, imperforate front wall 28 and two vertical side walls 30 (see FIG. 2). The other wall of the chute 26 includes a fixed wall portion 32 that extends downwardly from the chute opening 26 with a width that is substantially equal to the axial extent of the opening roller 18. This wall 32 includes a large plurality of perforations 34 formed in an area extending across the width thereof and extending above and below the normal level of fiber collected in the chute, this level being indicated by the reference letter L.

A movable wall portion 36 is located below, and as an extension of the perforated wall portion 32, and it is pivoted at the upper end 38 thereof for oscillating movement toward and away from the stationary front wall 28, such oscillating movement being obtained by a drive motor 40 and an eccentric linkage 42 connected at the bottom end of the wall portion 36.

A pair of conventional feed rollers 44 and 46 are disposed at the bottom of the chute 24 to deliver fiber from the chute 24 in batt form to further fiber processing equipment, such as a carding machine (not shown).

A horizontal divider wall 48 is disposed in the compartment 50 behind the perforated wall portion 32 and movable wall portion 36, and a spacing 52 is left between the end of divider wall 48 and perforated wall portion 32. A suitable air blower 54 is carried by the divider wall 48 with its inlet end disposed beneath the divider wall 48 and its outlet end located thereabove. It should also be noted that the lower portion of the compartment 50 is essentially sealed or closed, and an air sealing plate 56 is located adjacent the lower feed roller 44 to inhibit the flow of air into the lower end of the compartment 50. Likewise, the upper end of compartment 50 is essentially sealed or closed by the air sealing plate 58 and the housing walls 60 around the opening roller 18, and a partition wall 62 extends upwardly from the divider wall 48 to separate air flowing through the perforated wall portion 32 and air flowing from the outlet end of the blower 54. By virtue of the forgoing arrangement, the blower 54 generates an air current that flows essentially in a closed circuit, as indicated by the arrows 64, from the outlet of the blower 54, around the upper portion of the opening roller 18 in the direction of rotation thereof, then generally tangentially from the opening roller 18 toward the perforated wall portion 32, and then through the perforated wall portion 32 and the spacing 52 to the inlet side of the blower 54.

An electric eye 66 is housed in one of the side walls 30 of the apparatus at a point substantially between the upper and lower edge of the perforated wall portion 32 for the purpose of controlling the level L of the fiber in the apparatus in a conventional manner. Thus, when the fiber level L drops beneath a predetermined level, this drop will be sensed by the electric eye 66 which then generates a signal that operates the motor 14 to selectively drive the feed roller 12 whereby more fiber is fed thereby to the chute 24 by the opening roller 18. It is to be understood that the fiber level L will vary to some extent during the operation of the apparatus, but the vertical extent of the perforated wall portion 32 is selected to make sure that it extends above and below the normal level of the fiber collected in the chute, including the expected variations in such fiber level.

Figure 2:
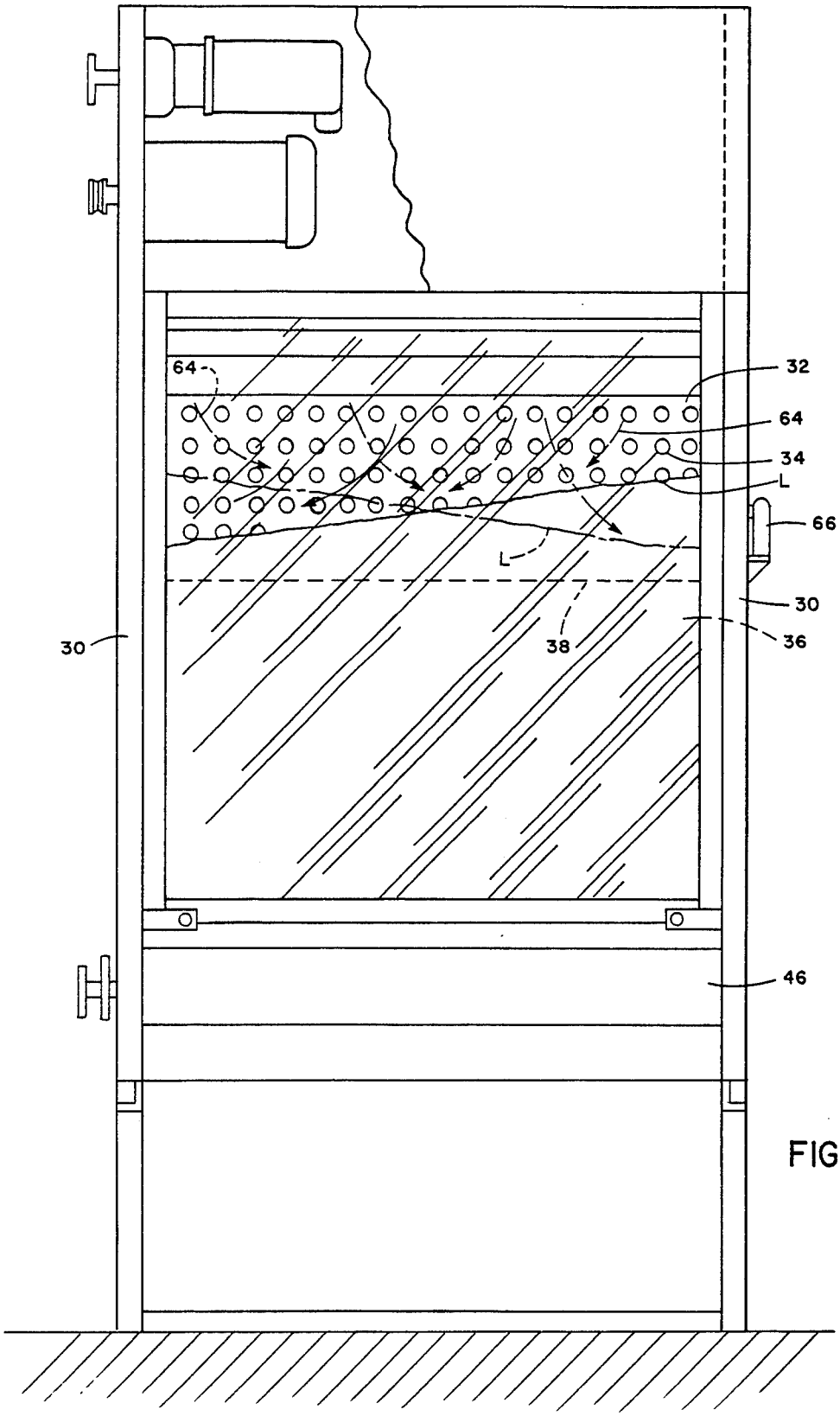
FIG. 2 is a diagrammatic front view of the apparatus illustrated in FIG. 1.

In FIG. 2, the fiber level L is shown in full lines as having an incline that extends upwardly toward the right so as to be unlevel with respect to a horizontal line. This is an undesirable condition because, as discussed above, it can result in more fiber collecting at one side of the chute 24 than the other, and the densification of the fiber by the oscillating wall portion 36 may result in the batt discharged through the feed rollers 44,46 having an uneven density across the width of the batt.

The aforesaid undesirable condition is corrected in accordance with the present invention by the combination of the air currents indicated by the arrows 64 and the perforated wall portion 32. Looking at FIG. 2, when the fiber level L inclines upwardly to the right as shown in full lines, it will be apparent that a greater portion of perforations 34 near the right side of wall portion 32 will be covered by fiber as compared with the more fully exposed perforations 34 near the left side of wall portion 32. As a result, the air currents leaving the surface of the opening roller 18 and being drawn through the perforated wall portion 32 by the suction of blower 54 will tend to flow in a direction toward the left in FIG. 2 where the greatest number of perforations 34 are uncovered. Since the fibers leaving the opening roller 18 have been opened, they are light and in the form of relatively loose tufts that will readily become entrained in even a gentle flow of air, and it will therefore be apparent that the number of fibers being carried to various points across the width of the perforated wall portion will be directly proportional to the area of the perforated wall portion which is not covered by fiber. Thus, in the full line condition shown in FIG. 2, more fibers will be carried toward the left to build up the low end of the fiber level until it becomes substantially level. Likewise, in the condition shown in dotted lines in FIG. 2, more fiber would be directed toward the right thereby tending, in the same manner described above, to equalize the level of the fiber. The two fiber level conditions illustrated in FIG. 2 are only exemplary, and it is to be understood that any imbalance or unevenness which occurs in the fiber level will be alleviated by the varying air currents flowing through the perforated wall portion 32.

Figure 3:
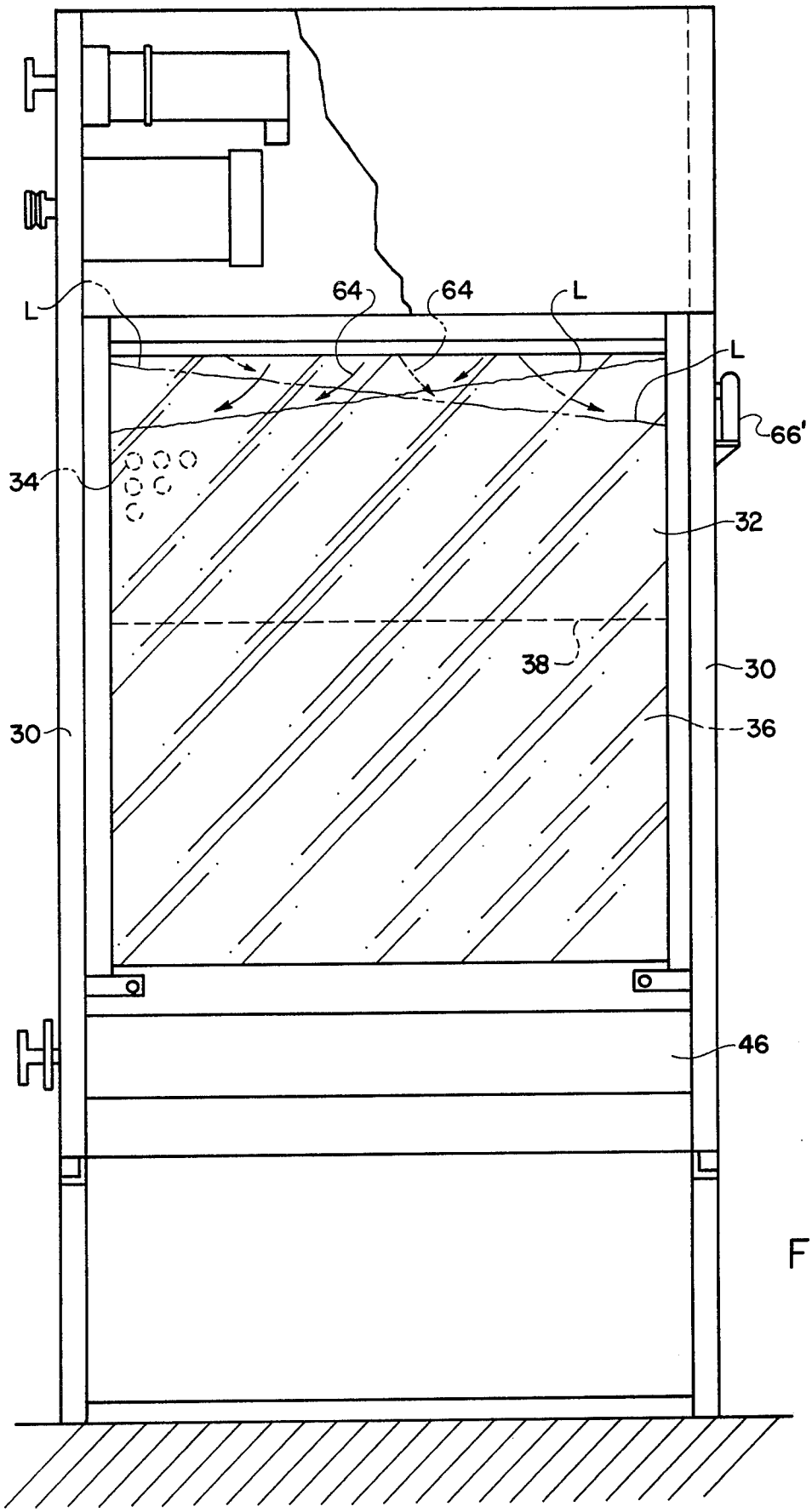
FIG. 3 is a diagrammatic front view, similar to FIG. 2, illustrating a second embodiment of the present invention.

It has also been found that satisfactory leveling of the fiber across the width of the chute can be obtained even if the perforations in the chute wall are all below, rather than above and below, the normal fiber level in the chute. Thus, FIG. 3 illustrates an alternate embodiment of the present invention which is substantially identical to the embodiment shown in FIGS. 1 and 2, and includes corresponding reference numerals, except that the electric eye 66' is located just above the top row of perforations 34 rather than at a location intermediate the vertical extent of such perforations. Since the electric eye 66' is located just above the top row of perforations 34, the normal fiber level L' will also usually be just above the top row of perforations 34. Nevertheless, because the fiber tufts collected at the top of the chute are relatively small in accumulated thickness and are in a relatively loose and non-compressed condition, the air flow passing around the opening roller 18 and toward the collected fibers, and the suction created by the blower 54 behind the perforated wall portion 32, will still cause the air to flow through the collected fibers above the perforations 34 and then through the perforations 34 themselves. Moreover, variations in the level of fiber across the width thereof, which are indicated by the reference character L' in full lines and in dotted lines in the same manner as that described in connection with FIG. 2, will result in a greater resistance to the air flow through the fiber in areas where there is a higher level of accummulated fiber and a lesser resistance to such air flow when the level of fiber is low. Thus, in this embodiment of the present invention, essentially the same leveling effect as that described above in connection with FIG. 2 is obtained even though the normal fiber level is above the highest row of perforations 34 so that such perforations 34 are not necessarily uncovered.

The present invention also realizes several additional advantages. First, since the closed air circuit described above flows around the upper portion of the opening roller 18 in the direction of rotation thereof and then generally tangentially therefrom toward the perforated wall portion 32, this air will assist in separating the light fiber tufts from the opening roller 18 and will assist in preventing suchs tufts from passing beyond the chute opening 26 so as to be carried around with opening roller 18 rather than being delivered to the chute 24. Additionally, because the air currents flow in a closed path within the apparatus, it is not necessary to filter such air to remove any lint therein, as would be the case if the air was permitted to leave the apparatus. Finally, since the air currents are used only to carry the light fiber tufts into the chute rather than to compress the fibers collected in the chute, only a relatively gentle air flow is required and a relatively small air blower 54 will be entirely adequate for the purposes of the present invention.

The present invention has been described in detail above for purposes of illustration only and is not intended to be limited by this description or otherwise to exclude any variation or equivalent arrangement that would be apparent from, or reasonably suggested by, the foregoing disclosure to the skill of the art.

We claim:

1. An apparatus for feeding fibers to textile processing equipment such as a carding machine, said apparatus including an axially extending rotatable opening roller and a substantially enclosed fiber collecting chute means extending generally downwardly beneath said opening roller, said chute means having an open upper and extending along and parallel to the axis of said opening roller to receive fibers as they leave said opening roller and having a wall extending generally downwardly from said open end with a width substantially equal to said axial extent of said opening roller, the improvement comprising:

(a) perforations formed in said chute wall in an area extending across the width thereof and extending above and below the normal level of fibers collected in said chute; and (b) means for generating a current of air that flows around the upper portion of said roller and generally tangentially therefrom toward said perforations to entrain said fibers leaving said opening roller and to assist in equalizing the level of fibers collected in said chute across the width thereof.

2. An apparatus for feeding fibers, the improvement defined in claim 1 and further characterized in that said air current generating means includes blower means located exteriorly of said chute wall with the suction side of said blower means being in open communication with said perforation.

3. An apparatus for feeding fibers, the improvement defined in claim 2 and further characterized in that the discharge of air from said blower means is directed around the upper half of said opening roller in the direction of said rotation thereof to form a closed air circuit through said perforations and said blower means and around said upper portion of said opening roller.

4. An apparatus for feeding fibers, the improvement defined in claim 1 and further characterized in that said chute wall includes a movable portion pivoted at the upper end thereof for oscillating movement with respect to an opposite wall of said chute to densify the fibers in said chute, said upper pivoted end of said movable wall portion being located beneath and adjacent said area of perforations in said chute wall.

5. An apparatus for feeding fibers, the improvement defined in claim 1 and further characterized in that said chute includes fiber level sensing means disposed therein adjacent the upper end thereof and at a level within the vertical limits of said area of perforations, and includes means for selectively controlling the supply of fibers to said chute in response to signals from said level sensing means.

6. Apparatus for feeding fibers to a carding machine or the like, said apparatus including an axially extending rotatable opening roller disposed above chute means having an open upper end extending along and parallel to the axis of said opening roller to receive fibers as they leave said opening roller, said chute means having generally downwardly extending imperforate walls forming a generally enclosed chamber with one of said walls havng a width corresponding to the axial length of said opening roller, the upper portion of said one wall having perforations formed therein in an area extending across the width thereof and extending above and below the normal level of fiber collected in said chute means and the portion of said one wall beneath said area of perforations being pivoted at the upper end thereof for oscillating movement with respect to an opposite wall of said chute means to densify fiber therebetween, and air circulating means including blower means located exteriorly of said chute with the suction side thereof in open communication with said perforations and including air passageways for forming a closed air circuit that flows from the outlet of said blower means, around the upper portion of said opening roller in the direction of rotation thereof, and generally tangentially therefrom toward and through said perforations to the inlet of said blower means.

7. Apparatus for feeding fibers as defined in claim 6 and further characterized in that fiber level sensing means is mounted in said chute means at a level corresponding to the normal level of fiber in said chute means, said sensing means generating a signal when the sensed level of said fiber falls beneath said normal level, and in that said opening roller is selectively operated to supply fibers to said chute means in response to receiving said signal from said fiber level sensing means.

8. An apparatus for feeding fibers to textile processing equipment such as a carding machine, said apparatus including an axially extending rotatable opening roller and a substantially enclosed fiber collecting chute means extending generally downwardly beneath said opening roller, said chute means having an open upper end extending along and parallel to the axis of said opening roller to receive fibers as they leave said opening roller and having a wall extending generally downwardly from said open end with a width substantially equal to said axial extent of said opening roller, the improvement comprising:

(a) perforations formed in said chute wall in an area that extends across the width thereof and that is adjacent to the normal level of fibers collected in said chute; and (b) means for generating a current of air that flows around the upper portion of said roller and generally tangentially therefrom toward said perforations to entrain said fibers leaving said opening roller and to assist in equalizing the level of fibers collected in said chute across the width thereof.

9. An apparatus for feeding fibers, the improvement defined in claim 8 and further characterized in that said perforations are formed in said chute wall in an area having an upper vertical limit that is just below said normal level of fibers collected in said chute.

10. An apparatus for feeding fibers, the improvement defined in claim 8 and further characterized in that said air current generating means includes blower means located exteriorly of said chute wall with the suction side of said blower means being in open communication with said perforation.

11. An apparatus for feeding fibers, the improvement defined in claim 10 and further characterized in that the discharge of air from said blower means is directed around the upper half of said opening roller in the direction of said rotation thereof to form a closed air circuit through said perforations and said blower means and around said upper portion of said opening roller.

12. An apparatus for feeding fibers, the improvement defined in claim 8 and further characterized in that said chute wall includes a movable portion pivoted at the upper end thereof for oscillating movement with respect to an opposite wall of said chute to densify the fibers in said chute, said upper pivoted end of said movable wall portion being located beneath and adjacent said area of perforations in said chute wall.

13. An apparatus for feeding fibers, the improvement defined in claim 8 and further characterized in that said chute includes fiber level sensing means disposed therein adjacent the upper end thereof and at a level just above the upper limits of said area of perforations, and includes means for selectively controlling the supply of fibers to said chute in response to signals from said level sensing means.

* * * * *